US005848483A

United States Patent [19]

Honda et al.

[11] Patent Number: 5,848,483

[45] Date of Patent: Dec. 15, 1998

[54] VENEER HEATING APPARATUS USING HOT PLATES AND STEAM ESCAPE MEANS

[75] Inventors: Noriyuki Honda; Yukio Abe; Makoto Isobe, all of Ohbu, Japan

[73] Assignee: Meinan Machinery Works, Inc., Aichi-ken, Japan

[21] Appl. No.: 834,341

[22] Filed: Apr. 16, 1997

[30] Foreign Application Priority Data

Apr. 22, 1996 [JP] Japan ..... 8-100494
Mar. 31, 1997 [JP] Japan ..... 9-080714

[51] Int. Cl.[6] ..... F26B 9/00

[52] U.S. Cl. ..... 34/662

[58] Field of Search ..... 34/144, 236, 662; 100/38, 93 P, 153; 156/470, 497, 583.3, 583.5; 198/834, 835, 844.2

[56] References Cited

U.S. PATENT DOCUMENTS 3,896,559 7/1975 Martin ..... 34/662
3,942,929 3/1976 De Mets ..... 100/153 X
4,128,373 12/1978 Greten ..... 425/371
4,811,496 3/1989 Honda et al. ..... 34/144

FOREIGN PATENT DOCUMENTS 48654 1/1973 Japan .
4827444 8/1973 Japan .

*Primary Examiner*—Henry A. Bennett
*Assistant Examiner*—Steve Gravini
*Attorney, Agent, or Firm*—Pearson & Pearson

[57] ABSTRACT

A veneer drying apparatus comprises a pair of upper and lower hot plates connected to a heating unit and a plurality of steam escape grooves formed in the opposing press surfaces of the upper and lower hot plates. The apparatus further comprises intermittently driven endless belts and driving and driven rollers on the unloading and loading ends, respectively, of the lower hot plate. The endless belts are trained over the driving and driven rollers for transferring veneer P over the upper surface of the lower hot plate. Each endless belt has numerous apertures formed in the entire surface thereof in a regular pattern. The driving rollers have numerous protrusions formed on the periphery thereof for engaging in the apertures formed in the endless belts. The endless belts are smoothly driven by rotation of the driving rollers due to the protrusion-aperture engagement. Not driven by friction, the endless belts can be relatively thin, so that the entire apparatus can be simplified and made smaller while achieving improved transfer of heat from the belt to veneer P and permitting easy belt replacement.

40 Claims, 10 Drawing Sheets

VENEER HEATING APPARATUS USING HOT PLATES AND STEAM ESCAPE MEANS

BACKGROUND OF THE INVENTION

1. Field of the Invention

The present invention relates to a veneer heating apparatus in which veneers are brought into contact with hot plates for heating the veneers and to remove moisture therefrom.

2. Description of the Prior Art

Conventionally, various apparatus, such as the hot press, have been employed to dry veneers. For example, Japanese Published Examined Patent Application No. 48-654 discloses a veneer drying apparatus which includes vertically movable upper and lower hot plates each having a pair of driving and driven rollers disposed on the loading and unloading ends thereof. The apparatus further includes an endless wire mesh belt mounted over the driving and driven rollers of each hot plate. The wire mesh belts transfers a veneer to a predetermined press-heating position between the hot plates.

Each of these endless wire mesh belts is driven by the friction between the corresponding driving roller and itself. Therefore, the belt tends to slip on the driving roller if the belt is under insufficient tension. Although such slippage can be avoided by holding the belt under greater tension, this gives rise to another problem. To hold the belt under greater tension, the bonding strength needs to be increased at the seam where the belt ends are connected. A common measure to achieve greater bonding strength would be to increase the bonding area of the belt ends, but this measure cannot be usually taken because the width of the endless belt is limited by the width of veneers to be dried. Thus, a thicker wire mesh belt is often employed to increase the bonding strength. However, a thick wire mesh belt has the problem that its low heat conductance reduces the veneer heating efficiency.

As a relatively large-diameter driving roller is required to steadily drive an endless wire mesh belt by friction, a drying apparatus using such belts cannot be easily downsized. Moreover, a tension device is required to produce sufficient friction and a tracking adjustment device needs to be installed to smoothly driving the endless wire mesh belt without lateral drift, making the drying apparatus more complex.

SUMMARY OF THE INVENTION

In view of the above-identified problems, an object of the present invention is to provide a veneer drying apparatus having endless belts that do not slip on the rollers over which the belts are mounted.

Another object of the present invention is to provide a veneer drying apparatus having endless belt driving rollers with a small diameter.

Still another object of the present invention is to provide a veneer drying apparatus having belt driving rollers with a small diameter.

Yet another object of the present invention is to provide a veneer drying apparatus having a simply constructed mechanism to drive endless belts for moving veneer to be dried.

Another object of the present invention is to provide a more compact veneer drying apparatus than conventional apparatuses.

The above object and other related objects are realized by providing a veneer drying apparatus which includes a pair of upper and lower hot plates adapted to be heated by heating means. Each of the hot plates has upper and lower surfaces and the upper surface of the lower hot plate and the lower surface of the upper hot plate constitute a pair of opposing upper and lower heating surfaces for heating a veneer therebetween. The veneer drying apparatus further includes rollers provided on loading and unloading sides of the lower hot plate and an intermittently drivable endless belt mounted over the rollers and adapted to travel over the upper surface of the lower hot plate from the loading side to the unloading side of the lower hot plate. The endless belt is adapted to transfer a veneer to a position between the pair of upper and lower hot plates and carrying off the veneer from the position. The apparatus also includes pressure means provided under and over the upper and lower hot plates for pressing and heating the veneer positioned between the upper and lower hot plates before the veneer is automatically carried off by the endless belt; steam escape means formed at least in the lower one of the two opposing heating surfaces of the upper and lower hot plates, the steam escape means being in communication with the outside thereof; numerous apertures formed in the entire surface of the endless belt, the apertures being arranged in a regular pattern in the traveling direction of the endless belt; and numerous protrusions provided on the periphery of each of the rollers for engaging in at least part of the numerous apertures of the endless belt. In this apparatus, the above regular pattern of the apertures is composed of units each of which corresponds to the length of the periphery of each of the rollers.

According to one aspect of the present invention, the protrusions are provided on the entire periphery of the rollers.

According to another aspect of the present invention, the protrusions are provided only on side edges of the periphery of the rollers.

According to still another aspect of the present invention, the endless belt is sectioned in the direction perpendicular to the traveling direction thereof.

According to yet another aspect of the present invention, the regular pattern of apertures is composed of staggered rows of apertures extending perpendicular to the traveling direction in each of which row the apertures are located at a regular pitch. The distance between any adjacent rows corresponds to half the distance of the regular pitch.

In accordance with another aspect of the present invention, each of the hot plates in which the steam escape means is formed has a plurality of openings on the side surfaces which extends in parallel to the traveling direction of the endless belt and the openings being in communication with the steam escape means.

According to one practice of the invention, the steam escape means comprises a plurality of steam escape grooves in communication with the outside of the hot plate.

According to another practice of the invention, the steam escape means comprises a plurality of steam escape holes in communication with the outside of the hot plate.

The present invention further provides for a multiple-tiered veneer drying apparatus including a plurality of vertically disposed hot plates capable of being stacked on top of each other, each hot plate being adapted to be heated by heating means. Each of the hot plates except the uppermost and lowermost hot plates has upper and lower heating surfaces whereas the uppermost hot plate has a lower heating surface only and the lowermost hot plate has an upper heating surface only. The veneer drying apparatus also includes transfer means provided for each hot plate including rollers provided on loading and unloading sides of each hot plate and an intermittently drivable endless belt mounted over the rollers. The endless belt travels over the upper surface of the hot plate from the loading side to the unloading side of the hot plate so as to transfer a veneer to a position between the hot plate and the hot plate disposed immediately above thereof and to carry off the veneer from the position. The veneer drying apparatus further includes: pressure means provided under the lowermost hot plate and over the uppermost hot plate for pressing and heating the veneers positioned between the hot plates before the veneers are automatically carried off by the endless belts; steam escape means formed in at least one of the two opposing heating surfaces of each pair of opposing hot plates. The steam escape means is in communication with the outside thereof. Also included in the apparatus are numerous apertures formed in the entire surface of each endless belt and numerous protrusions provided on the periphery of each of the rollers for engaging in at least part of the numerous apertures of the corresponding endless belt. The apertures are arranged in a regular pattern in the traveling direction of the endless belt. The regular pattern of the apertures is composed of units each of which corresponds to the length of the periphery of each of the rollers.

According to one practice of the invention, the steam escape means is formed only in the upper one of the two opposing heating surfaces of each pair of opposing hot plates.

According to another practice of the invention, the veneer drying apparatus further includes a hot plate not provided with transfer means. This hot plate is disposed over the uppermost hot plate provided with transfer means so as to make a pair for performing heating and pressing.

According to another practice of the invention, the protrusions are provided on the entire periphery of the rollers.

According to still another practice of the invention, the protrusions are provided only on side edges of the periphery of the rollers.

In one aspect, the endless belts are sectioned in the direction perpendicular to the traveling direction thereof.

In another aspect, the regular pattern of apertures is composed of staggered rows of apertures extending perpendicular to the traveling direction in each of which row the apertures are located at a regular pitch, with the distance between any adjacent rows corresponding to half the distance of the regular pitch.

In still another aspect, each of the hot plates in which the steam escape means is formed has a plurality of openings on side surfaces thereof. The side surfaces extend in parallel to the traveling direction of the endless belt and the openings being in communication with the steam escape means.

In still another aspect, the steam escape means comprises a plurality of steam escape grooves in communication with the outside of the hot plate.

In carrying out the invention in one preferred mode, the steam escape means comprises a plurality of steam escape holes in communication with the outside of the hot plate.

BRIEF DESCRIPTION OF THE DRAWINGS

For a fuller understanding of the nature and objects of the present invention, reference should be made to the following detailed description and the accompanying drawings, in which.

DETAILED DESCRIPTION OF THE PREFERRED EMBODIMENTS

Preferred embodiments of the present invention will be explained hereinafter with specific reference to the attached drawings.

First embodiment

Figure 1:
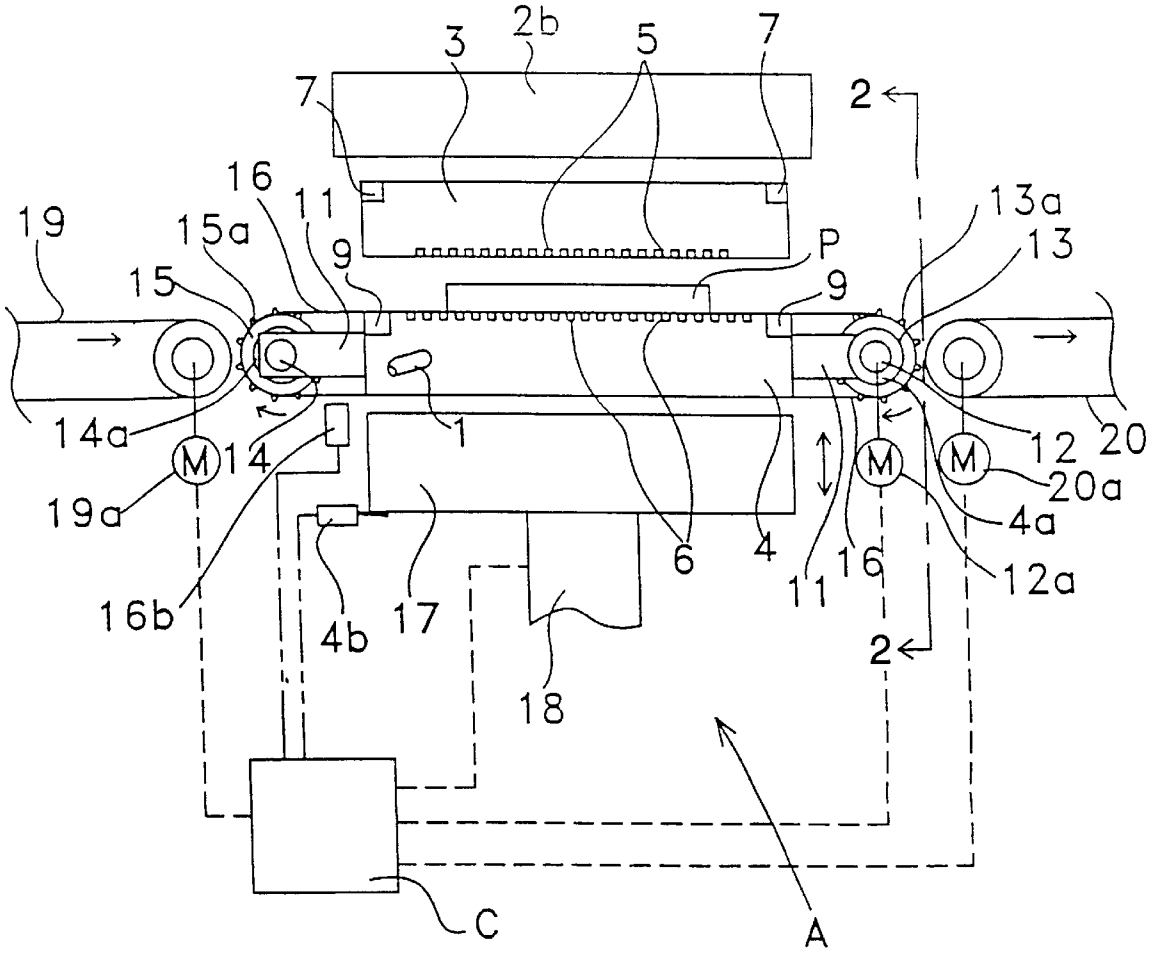
FIG. 1 is a side view of an essential part of a veneer drying apparatus of a preferred embodiment according to the invention.
Figure 2:
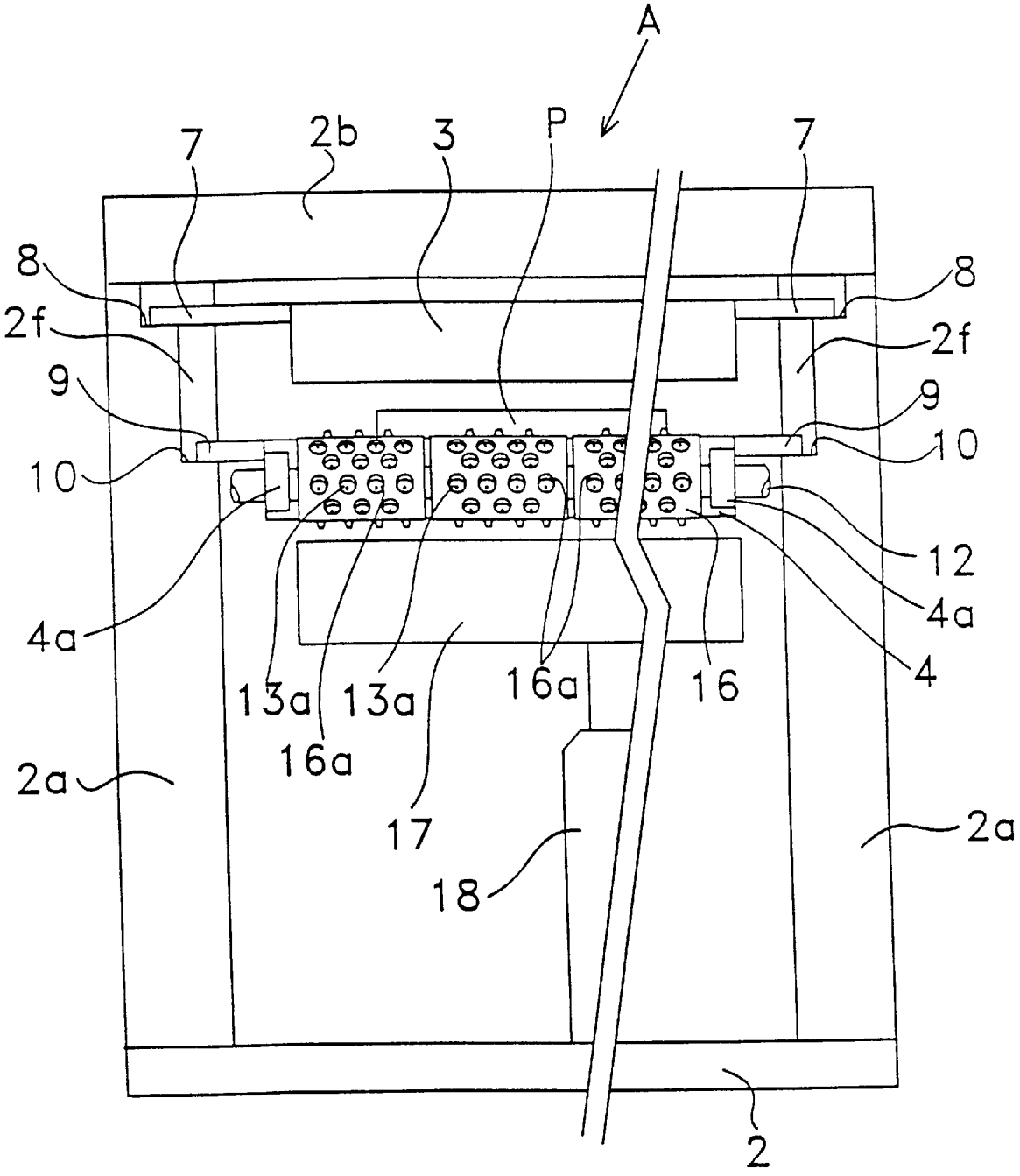
FIG. 2 is an front view of the veneer drying apparatus taken on alternate long and short dash line 2—2 of FIG. 1.
Figure 3:
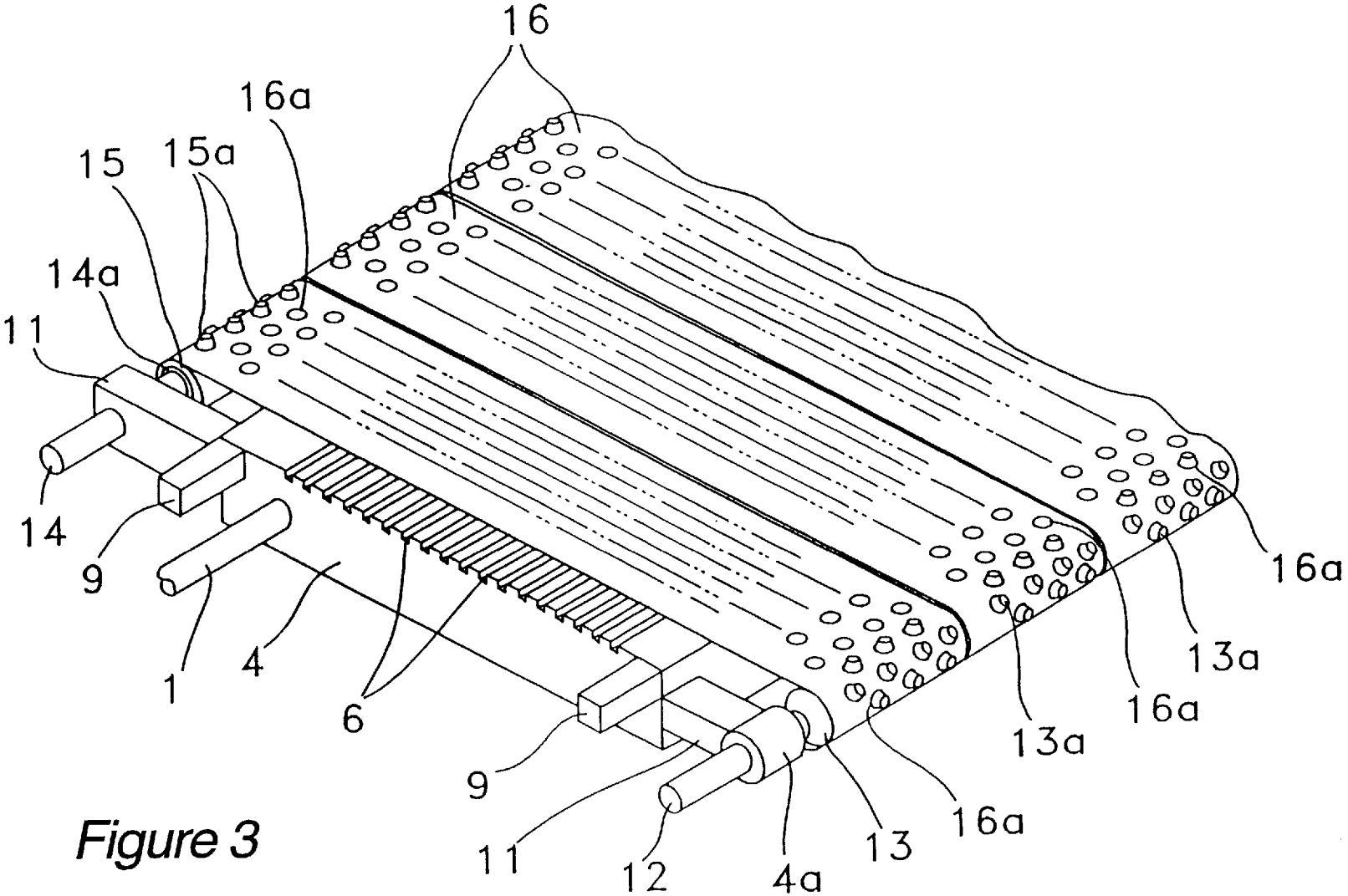
FIG. 3 is a partial view in perspective of the lower hot plate and the endless belts of FIG. 1.

FIG. 1 is a side view of the essential part of a veneer drying apparatus A of the first embodiment of the invention. FIG. 2 is a front view of the veneer drying apparatus A taken on alternate long and short dash line 2—2 of FIG. 1. In this apparatus, veneer P is transferred from the left to the right of FIG. 1. This left-right direction is referred to as the longitudinal direction throughout the embodiment section while the direction perpendicular to the longitudinal direction is referred to as the lateral direction.

The veneer drying apparatus A is provided with a base 2, four support posts 2*a* erected on the four corners of the base 2, and an abutment plate 2*b* supported by the support posts 2*a*. Also provided are a pair of upper and lower hot plates 3 and 4 that are heated to approximately 150 degrees Celsius by steam supplied by flexible hoses 1 connected thereto as shown in FIG. 1. Each of the hot plates 3 and 4 has a length of 1500 mm (the length is shown in FIG. 1), a width of 2500 mm (the width is shown in FIG. 2), and a thickness of 80 mm. The lower surface (heating surface) of the upper hot plate 3 and the upper surface (heating surface) of the lower plate 4 constitute a pair of opposing press surfaces. Two other flexible hoses for discharging drain (not shown) are connected to the side surfaces of the hot plates 3 and 4 to which the flexible hoses 1 are not connected.

The opposing press surfaces of the upper hot plate 3 and the lower plate 4 have rows of steam escape grooves 5 and 6, respectively, formed across the width thereof at a 12 mm pitch. Each groove is 3 mm wide and 2 mm deep. The steam escape grooves 5 are out of vertical alignment with the steam escape grooves 6 by half the above pitch or 6 mm in the longitudinal direction.

The hot plate 3 has four first arms 7 extending horizontally from the four corners thereof in the lateral direction.

The hot plate 3 is located in a predetermined position as the first arms 7 are supported by upper shoulders 8 formed in outer surfaces 2*f* of the support posts 2*a*. Likewise, the hot plate 4 has four first arms 9 extending horizontally from the four corners thereof in the lateral direction. The hot plate 4 is located in a predetermined position as the first arms 9 are supported by lower shoulders 10 formed in the outer surfaces 2*f* of the support posts 2*a*. The upper and lower shoulders 8 and 10 of each support posts 2*a* are formed in a manner of inwardly descending steps. The hot plates 3 and 4 are vertically moved and stacked together by a hydraulic cylinder 18 (explained in detail hereinafter). As the hot plates 3 and 4 are vertically moved, the first arms 7 and 9 are also vertically moved along the outer surfaces 2*f* of the posts 2*a*. The posts 2*a* are fitted between the first arms 7 and 9, thereby preventing the first arms from moving in the longitudinal direction.

Referring to FIG. 1, the hot plate 4 has four second arms 11 horizontally extended therefrom in a perpendicular direction to the first arms 9. A driving shaft 12 is freely rotatably mounted between the front (the right side in FIG. 1) pair of the second arms 11 via a pair of bearings 4*a*. Ten 250 mm-long rollers 13 are arranged side by side on the driving shaft 12 at close intervals. The rollers 13 are secured to the driving shaft 12 by the known method of fitting a key into a matching key groove. Provided on the outer periphery of each roller 13 are lateral rows of frustum-shaped protrusions 13*a* in a staggered configuration. The protrusions 13*a* in each row are 6 mm high and occur at a 50 mm pitch. The pitch between adjacent rows is 25 mm. Also, the rows of apertures are staggered at half pitch points (or 25 mm) in relation to each other. The driving shaft 12 is coupled to a servo motor 12*a* via a chain or some other suitable power transmission device, so that the rollers 13 can be freely rotated clockwise as indicated by the curved arrows in FIG. 1 and stopped.

A driven shaft 14 is mounted between the rear (the left side in FIG. 1) pair of the second arms 11 via a pair of bearings 14*a*. In the same manner as above, ten 250 mm long rollers 15 are arranged side by side on the driven shaft 14 at close intervals. The rollers 15 are freely rotatably secured to the driving shaft 12 by the known method of fitting a key into a matching key groove. Provided on the outer periphery of each roller 15 are lateral rows of protrusions 15*a* in a staggered configuration. The protrusions 15*a* (identical to the protrusions 13*a*) in each row are 6 mm high and are arranged at a 50 mm pitch. The pitch between adjacent rows is 25 mm. Also, the rows of protrusions are staggered at half pitch points. The distance between the two shafts 12 and 14 is 1800 mm.

Ten endless belts 16 (each having a width of 250 mm and a thickness of 0.5 mm) made of stainless steel are mounted over the ten pairs of rollers 13 and 15. Each belt has numerous rows of 12 mm-diameter small apertures 16*a* formed on their entire surfaces. The rows of apertures 16*a* are arranged so that the protrusions 13*a* and 15*a* of the driving and driven rollers 13 and 15, respectively, can fit in the apertures. The apertures 16*a* in each row are arranged at a regular pitch (50 mm) and the distance between any two adjacent rows is half the pitch (25 mm). A preferred method of training an endless belt 16 over a pair of rollers 13 and 15 consists of the steps of looping the belt over the rollers and bonding both ends of the belt with a heat-resistant adhesive tape. It is preferable to vertically align the rows of small apertures 16*a* with the centers of the steam escape grooves 5 and 6.

When the servo motor 12*a* rotates the driving shaft 12 with the belts 16 set on the rollers 13 and 15 as described above, the rollers 13 also start to rotate. Since the protrusions 13*a* are engaged in the apertures 16*a*, the drive rollers 13 drive the endless belts 16 to travel in the clockwise direction in FIG. 1. The freely rotatable driven rollers 15 are simultaneously rotated by the endless belts 16. In this way, the rollers 13 and 15 and the endless belts 16 are driven and stopped by intermittent operation of the servo motor 12*a* while the apertures 16*a* are engaged with and disengaged from the protrusions 13*a* and 15*a*.

Provided under the hot plate 4 is a support plate 17 which has the same length and width as, but is stiffer than, the hot plate 4. The support plate 17 is elevated and lowered by the pressure-adjustable hydraulic cylinder 18 provided under the hot plate 4. The support plate 17, the hydraulic cylinder 18, and the abutment plate 2*b* cooperate to press the hot plates 3 and 4 from above and below. The hydraulic cylinder 18 is pre-adjusted to apply a pressure of 2 kg per square centimeter to veneer P.

A loading conveyer 19 is installed at the rear of the rollers 15 to deliver veneer P onto the endless belts 16. Likewise, an unloading conveyer 20 is installed in front of the rollers 13 to carry out veneer P from the endless belts 16. Both of the conveyers 19 and 20 are coupled to servo motors 19*a* and 2*a*, respectively, for driving and stopping the conveyers in synchronization with the servo motor 12*a* for the driving shaft 12.

Figure 4:
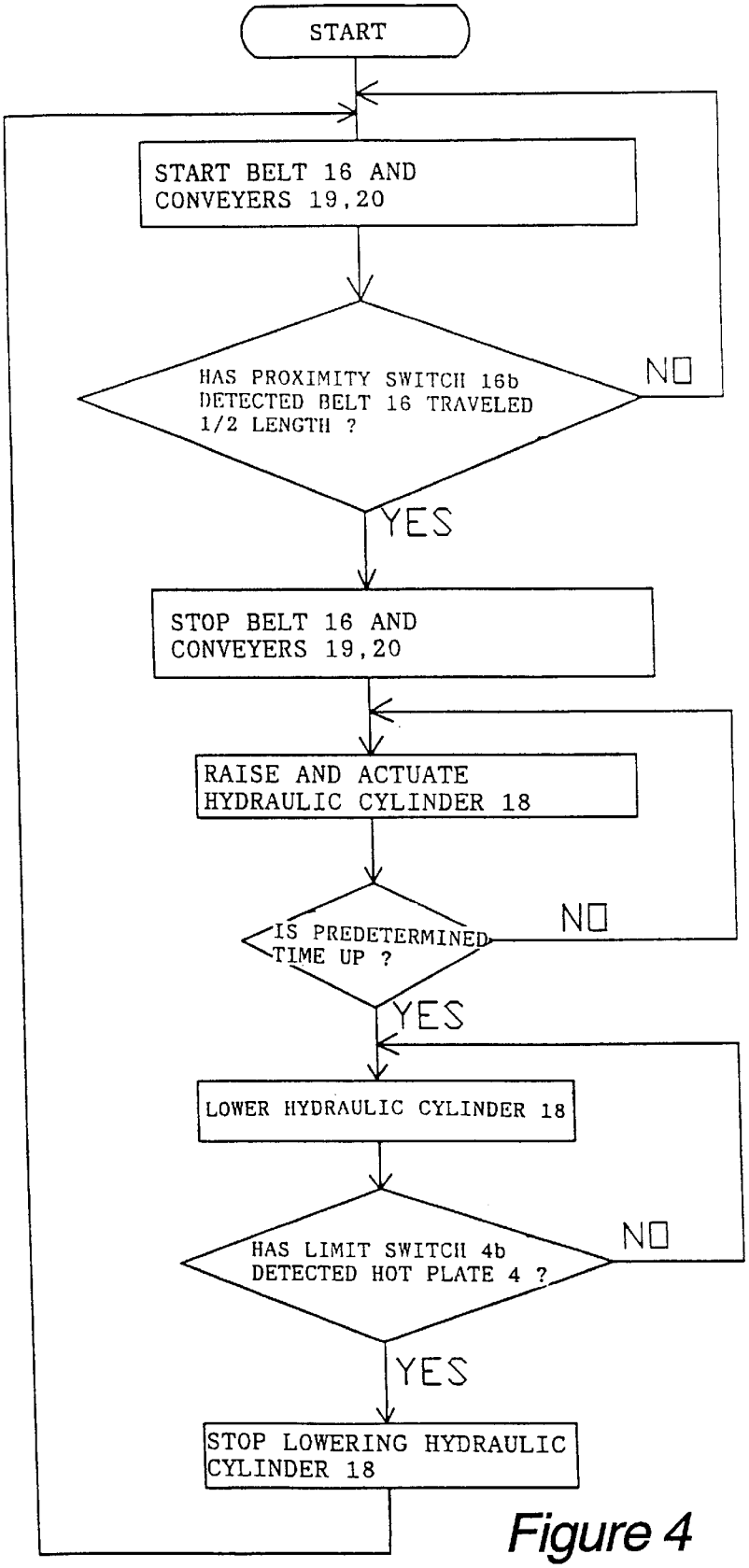
FIG. 4 is a flowchart representing the operation of the veneer drying apparatus of FIG. 1.

Also included in the drying apparatus A is a proximity switch 16*b* for generating a signal upon detection of one of the two cut-outs (not shown) made in each endless belt 16. The cut-outs are spaced apart from each other by half the length of the endless belt 16. Also, a limit switch 4*b* is provided for generating a signal upon detection of the support plate 17 at the bottom dead point shown in FIG. 1. A control unit C is provided for controlling the operation of the drying apparatus A responsive to these detection signals received from the proximity and limit switches. The flowchart of FIG. 4 represents the manner in which control unit C controls the operation of the drying apparatus A as follows.

The loading and unloading conveyers 19 and 20 and the endless belts 16 start to travel in the direction indicated by the respective arrows under the condition as shown in FIG. 1. When the endless belts 16 have traveled half of their length, the proximity switch 16*b* detects a cut-out and generates a detection signal. Responsive to the signal, control unit C stops the loading and unloading conveyers 19 and 20 and the endless belts 16*b*. Then, the hydraulic cylinder 18 is elevated to compress the upper and lower hot plates 3 and 4. In the next step, a restart signal is generated by control unit C to lower the hydraulic cylinder 18 upon expiration of a predetermined time. When the hot plate 4 has returned to its lower position (as shown in FIG. 1), the limit switch 4*b* sends a detection signal to control unit C. In response to the signal, control unit C stops the hydraulic cylinder 18 lowering and also causes the loading and unloading conveyers 19 and 20 and the endless belts 16*b* to restart traveling thereby to repeat the same procedure.

The following is a detailed explanation of the operation of the first embodiment of the present invention.

Veneer P having a thickness of 3 mm, a length of 1800 mm (parallel to the direction of the fibers), and a width of 900 mm is set on the loading conveyer 19 with the direction of the fibers perpendicular to the traveling direction of the conveyer. This setting position is located half the length of the belt 16 upstream in the traveling path from the position in FIG. 1 in which veneer P is pressed. When veneer P is in the setting position on the conveyer 19, the loading and unloading conveyers 19 and 20 and the endless belts 16*b* start to travel simultaneously.

When veneer P is transferred from the loading conveyer 19 onto the endless belts 16 and, after having traveled half the belt length, reaches the position shown in FIG. 1, the proximity switch 16*b* sends a detection signal to control unit C. Responsive to the signal, control unit C sends stop signals to the servo motors 19*a*, 12*a*, and 20*a* to suspend the operation of the conveyers 19 and 20 and the belts 16. At this point, the small apertures 16*a* of the endless belts 16 are located over or vertically aligned with the centers of the steam escape grooves 6 formed in the upper surface of the lower hot plate 4.

The hydraulic cylinder 18 is then operated to raise the support plate 17 and thus the lower hot plate 4 responsive to a signal generated by control unit C. As the hot plate 4 is raised with the rollers 13 and 14, the endless belts 16, and veneer P, the first arms 9 is lifted off the lower shoulders 10. Subsequently, the lower hot plate 4 comes into contact with the upper hot plate 3 via veneer P and also raises the upper hot plate while lifting the first arms 7 off of the upper shoulders 8. If the hydraulic cylinder 18 continues to rise, the hot plates 3 and 4 eventually abut on the abutment plate 2*b* while sandwiching veneer P. After the abutment, the pressure of the hydraulic cylinder 18 increases until reaching the aforementioned predetermined value. After that, the pressure is maintained for a predetermined time.

In the mean time, the hot plate 3 heats the upper side of veneer P while the hot plate 4 heats its lower side via the endless belts 16, thereby vaporizing moisture inside veneer P. If the hot plates 3 and 4 completely seal both sides of veneer P without any gap, the vapor or steam would be trapped and the veneer P would explode. In this embodiment, the steam is released into the atmosphere through the numerous small apertures 16*a* in the endless belts and the steam escape grooves 5 and 6 in the hot plates 3 and 4, respectively, as explained before.

The time for heating veneer P with the hot plates 3 and 4 is predetermined according to the pre-drying moisture content, thickness, and desired post-drying moisture content of veneer P. Generally, the post-drying moisture content of about 10% is suitable for bonding veneers with adhesive.

To improve the operation efficiency, the next veneer to be dried should be set on the loading conveyer 19 while veneer P is being dried.

Upon expiration of the predetermined drying time, control unit C generates a signal to cause the hydraulic cylinder 18 to lower the support plate 17, the hot plates 3 and 4, and veneer P while interposed between the hot plates. While descending, the first arms 7 of the hot plate 3 rest on the upper shoulders 8 in the lower position shown in FIG. 1 and 2. Likewise, the first arms 9 of the hot plate 4 rest on the lower shoulders 10 in the lower position with veneer P still on the hot plate 4. As the support plate 17 continues its descent, the Limit switch 4*b* eventually detects the support plate reaching the bottom dead point and generates a detection signal. The hydraulic cylinder 18 stops descending in response to this signal.

Then, a restart signal is generated by control unit C to restart the Loading and unloading conveyers 19 and 20 and the endless belts 16 in the direction indicated by the arrows, thereby transferring veneer P from the endless belts 16 onto the unloading conveyer 20. Meanwhile, the next unheated veneer P is transferred half the length of an endless belt 16 and set between the hot plates, starting the same drying procedure again.

The veneer drying apparatus of the first embodiment offers the following advantages.

As the engagement of the protrusions 13*a* of the rollers 13 in the apertures 16*a* of the endless belts 16 is sufficiently secure for the rollers 13 to drive the belts 16, so that no separate apertures or holes for belt driving are required. The secure aperture-protrusion engagement prevents slippage of the belts on the rollers, thus ensuring reliable belt travel.

Moreover, the endless belts 16 of the embodiment are not driven by the friction between the belts and the rollers but by the aperture-protrusion engagement. This helps lower the tension on the endless belts 16, making it possible to bonding the end portions of each belt by adhesive taping. Additionally, such tape boding is a simple operation as it requires no special equipment. Alternatively, if the end portions of the endless belt 16 are bonded by welding, the welded area can be minimized due to the low tension, which enhances the conduction of heat from the hot plate 4 to veneer P.

As thick belts are difficult to bend to form a small radius, they need to be trained over large-diameter rollers. However, as the endless belts of the embodiment can be made quite thin as previously mentioned, the diameter of the driving rollers 13 can be small, thus reducing the height of the entire apparatus.

The conventional apparatus describe d above requires a tension device to keep the wire mesh belt pressed on the rollers and a separate track adjustment device for preventing the wire mesh belt from drifting. The apparatus of this embodiment requires neither of these devices.

As the ten endless belts 16 are mounted on, and driven by, the respective driving rollers 13, the belts 16 can be held under equal tension and thus less easily damaged. If one belt is damaged, there is no need to replace all the belts; only the damaged one needs to be replaced, thereby reducing the maintenance cost of the apparatus. In addition, one endless belt 16 can be more easily replaced than a combined wide belt covering the entire width of the rollers.

Also in the embodiment, the steam escape grooves 5 and 6 extend perpendicularly to the traveling direction of the endless belts 16, so that vaporized moisture of veneer P is discharged also perpendicularly to the belt traveling direction. This prevents the vapor from coming into direct contact with the loading and unloading conveyers 19 and 20, thus rusting the metal portions and degrading the rubber portions of these components due to condensation. This also prevents a decrease in the temperatures of the above components by condensation on the endless belts 16 and also prevents a reduction in the drying efficiency of the apparatus due to condensation on the next veneer.

Second embodiment

The second embodiment of the present invention will be explained hereinafter with reference to the attached drawings.

Figure 5:
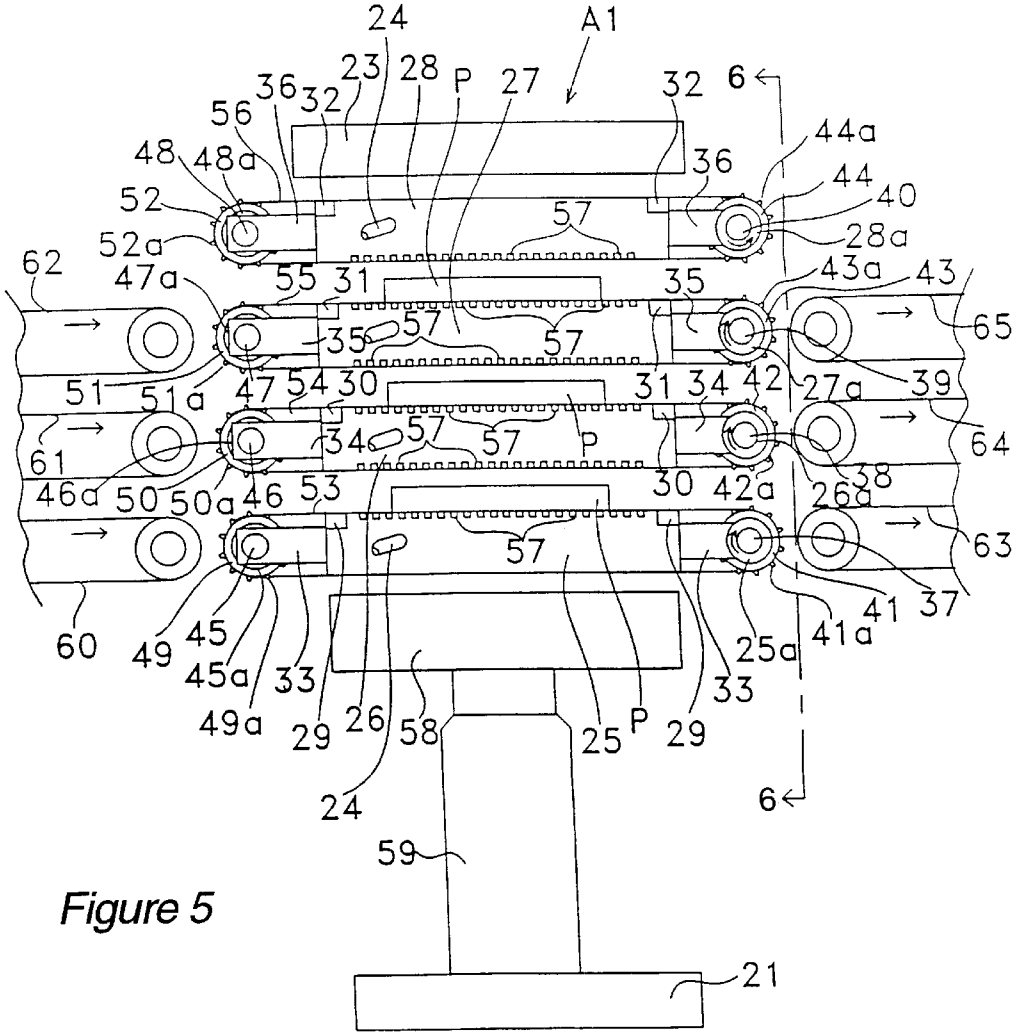
FIG. 5 is a side view of an essential part of a veneer drying apparatus of an alternate embodiment according to the invention.
Figure 6:
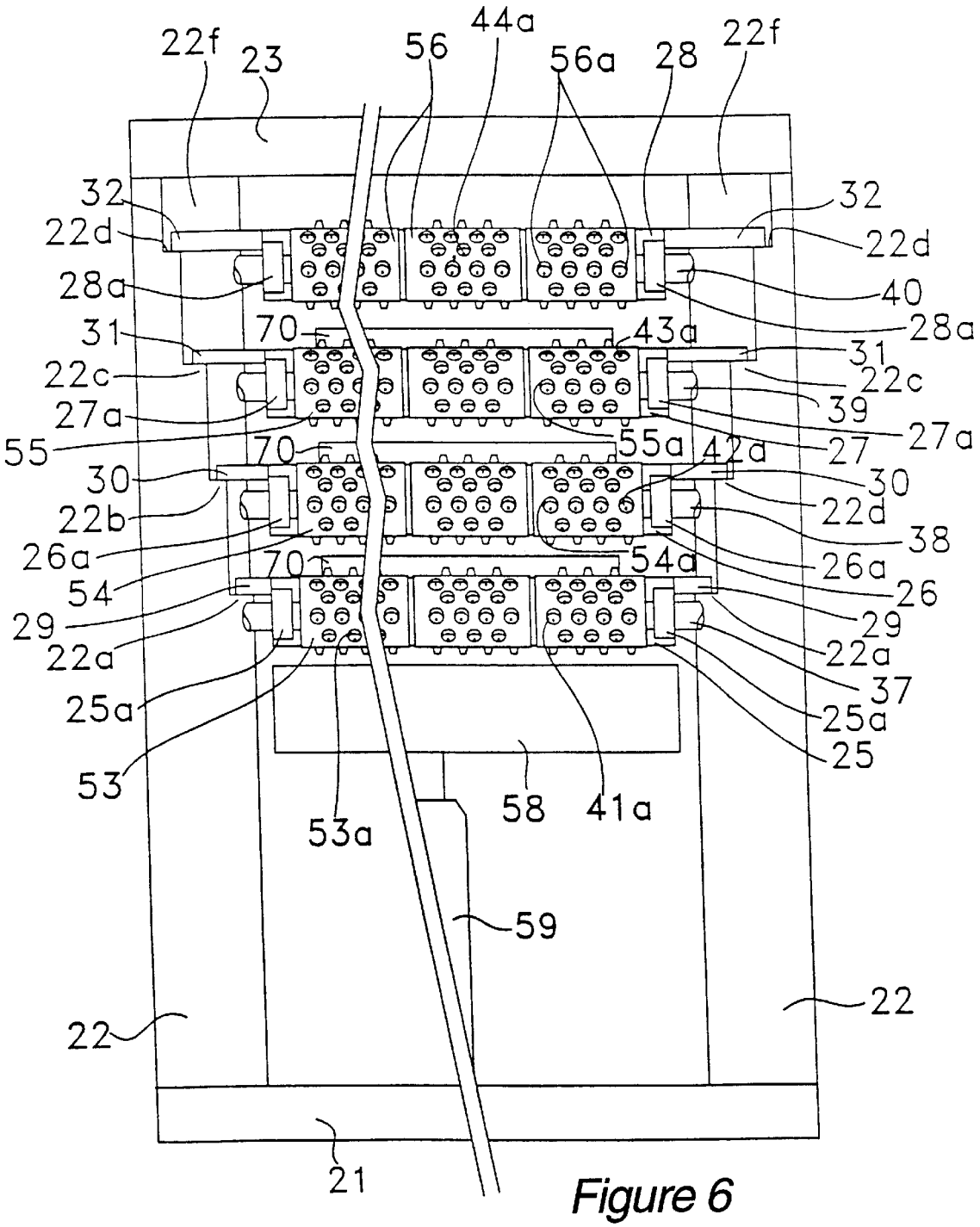
FIG. 6 is an front view of the veneer drying apparatus taken on alternate long and short dash line 6—6 of FIG. 5.

FIG. 5 is a side view of the essential part of a veneer drying apparatus A1 of the second embodiment of the invention. FIG. 6 is a front view of the veneer drying apparatus A1 taken on alternate long and short dash line Y—Y of FIG. 5. In this apparatus, veneers P are transferred from the left to the right of FIG. 5. This left-right direction is referred to as the longitudinal direction throughout the embodiment section while the direction perpendicular to the longitudinal direction is referred to as the lateral direction.

The drying apparatus A1 is provided with a base 21, four support posts 22 erected on the four corners of the base 21, and an abutment plate 23 supported by the support posts 22. Also provided are a plurality of vertically aligned hot plates 25–28 that are heated to approximately 150 degrees Celsius by steam supplied by respective flexible hoses 24 connected thereto. Each of the hot plates 25–28 has a length of 1500 mm (the length is shown in FIG. 1), a width of 2500 mm (the width is shown in FIG. 2), a thickness 80 mm. The lower surfaces of the top three hot plates and the upper surfaces of the bottom three lower plates constitute three pairs of opposing press surfaces.

The upper surface of the hot plate 25, the upper and lower surfaces of the hot plates 26 and 27, and the lower surface of the hot plate 28 have rows of steam escape grooves 57 formed across the width thereof at a 12 mm pitch. Each groove 57 is 3 mm wide and 2 mm deep. The grooves formed in one press surface are out of vertical alignment with the grooves formed in the opposing press surface by half the above pitch or 6 mm in the longitudinal direction.

Each of the hot plates 25–28 has four first arms 29–32, respectively, extending horizontally from the four corners thereof in the lateral direction. The hot plates 25–28 are located in a predetermined position as the first arms 29–32 are supported by respective shoulders 22*a*–22*d* formed in outer surfaces 22*f* of the support posts 22. The shoulders 22*a*–22*d* of each support posts 22 are formed in a manner of inwardly descending steps. The hot plates 25–28 are vertically moved and stacked together by a hydraulic cylinder 59 (explained in detail hereinafter). As the hot plates 25–28 are vertically moved, the first arms 29–32 are also vertically moved along the outer surfaces 22*f* of the posts 22. The posts 22 are fitted between the first arms 29–32, thereby preventing the first arms from moving in the longitudinal direction.

Referring to FIG. 5, the hot plates 25–28 each have four second arms 33–36, respectively, horizontally extended therefrom in a perpendicular direction to the first arms 29–32. Driving shafts 37–40 are freely rotatably mounted between the respective front (the right side in FIG. 5) pairs of the second arms 33–36 via a pair of bearings 25*a*–28*a*. A plurality of 250 mm-long rollers 41–44 are arranged side by side on the driving shafts 37–40, respectively, at close intervals. The rollers 41–44 are secured to the driving shaft 37–40, respectively, by the known method of fitting a key into a matching key groove. Provided on the outer periphery of the rollers 41–44 are lateral rows of frustum-shaped protrusions 41*a*–44*a* (identical to the protrusions 13*a* of the first embodiment) in the same staggered configuration as in the first embodiment. Each of the driving shafts 37–40 is coupled to a servo motor (not shown) via a chain or some other suitable power transmission device, so that the rollers 41–44 can be freely rotated as indicated by the curved arrows in FIG. 5 and stopped. It should be noted that the rollers 44 rotate in the opposite, counterclockwise direction.

Driven shafts 45–48 are mounted between the rear (the left side in FIG. 5) pairs of the second arms 33–36 via pairs of bearings 45*a*–48*a*, respectively. In the same manner as above, a plurality of 250 mm long rollers 49–52 are arranged side by side on the driven shafts 45–48 at close intervals. The rollers 49–52 are freely rotatably secured to the driven shafts 45–48, respectively, by the known method of fitting a key into a matching key groove. Provided on the outer periphery of each of the rollers 49–52 are lateral rows of protrusions 49*a*–52*a* identical to the protrusions 41*a*–44*a* in the identical staggered configuration. The distance between each pair of the driving shafts 37–40 and the driven shafts 45–48 is 1800 mm.

A plurality of endless belts 53–56 (identical to those in the first embodiment) are trained over pairs of the driving shafts 37–40 and the driven shafts 45–48, respectively, in the same manner as in the first embodiment. The endless belts 53–56 have numerous rows of small apertures 53*a*–56*a*, respectively, formed in their entire surfaces. The staggered configuration and the size of the apertures 53*a*–56*a* are also the same as in the first embodiment. The method of fitting the endless belts 53–56 over the driving shafts 37–40 and the driven shafts 45–48 is also the same as in the first embodiment, so that the explanation thereof is dispensed with. It is also preferable in this embodiment to vertically align the rows of small apertures with the centers of the steam escape grooves 57.

When the servo motors (not shown) rotate the driving shafts 37–40 with the belts 53–56 mounted on the rollers as described above, the rollers 41–44 also start to rotate. Since the protrusions 41*a*–44*a* are engaged in the respective apertures 53*a*–56*a*, the protrusions 41*a*–44*a* cause the respective endless belts 53–56 to travel. The freely rotatable driven rollers 49–52 are simultaneously rotated by the endless belts 53–56. The rollers and the endless belts are driven and stopped by intermittent operation of the servo motors in the same manner as in the first embodiment.

Provided under the lowest hot plate 25 is a support plate 58 which has the same length and width as, but is stiffer than, the hot plate 25. The pressure-adjustable hydraulic cylinder 59 is provided under the support plate 58 to elevate and lower the support plate. The support plate 58, the hydraulic cylinder 59, and the abutment plate 23 cooperate to vertically press the hot plates 25–28. The hydraulic cylinder 59 is pre-adjusted to apply a pressure of 2 kg per square centimeter to veneers P.

Referring again to FIG. 5, loading conveyers 60–62 are installed at the rear of the driven rollers 49–51 to transfer veneers P onto the endless belts 53–55. Likewise, unloading conveyers 63–65 are installed in front of the driving rollers 41–43 to carry out veneers P from the endless belts 53–55. Both of the conveyers 60–62 and 63–65 are coupled to servo motors (not shown) for driving and stopping the conveyers in synchronization with the servo motor for driving the driving shafts.

As in the first embodiment, the drying apparatus A1 also includes a proximity switch for each set of endless belts for generating a signal upon detection of one of the two cut-outs (not shown), a limit switch for generating a signal upon detection of the support plate 58 at the bottom dead point, and a control unit for controlling the operation of the drying apparatus A1 responsive to these detection signals received from the proximity and limit switches. As the operation of these elements is identical to that in the first embodiment, these elements are omitted from the drawings.

The following is a detailed explanation of the operation of the second embodiment of the present invention.

Three veneers P each having a thickness of 3 mm, a length of 1800 mm (parallel to the direction of the fibers), and a width of 900 mm are set on the loading conveyers 60–62 with the direction of the fibers perpendicular to the traveling direction of the conveyers. These setting positions are located half the length of the belt 16 upstream in the traveling path from the positions in FIG. 5 in which veneers P are compressed. When veneers P are in the setting positions, the loading and unloading conveyers and the endless belts start to travel simultaneously.

When veneers P are transferred from the loading conveyers 60–62 onto the endless belts 53–55 and reaches the positions shown in FIG. 5 after having traveled half the belt length, the proximity switches send a detection signal to the control unit. Responsive to the signal, the control unit sends stop signals to the servo motors to suspend the operation of the conveyers and the endless belts. At this point, the small apertures 53*a*–56*a* of the endless belts are vertically aligned with the centers of the steam escape grooves 57 formed in the upper surfaces of the hot plate 25–27 and the lower surface of the hot plate 28. It should be noted that veneer P transferred by the loading conveyer 62 can be delivered and carried off in a more favorable manner since the endless belts 55 and 56 run in the same direction toward the unloading side.

In the next step, the hydraulic cylinder 59 is operated to raise the support plate 58 and then the lowest hot plate 25 responsive to a signal generated by the control unit. As the hot plate 25 is raised with the rollers 41 and 49 and the endless belts 53 while loaded with veneer P, the first arms 29 are lifted off the shoulders 22*a*. Subsequently, the hot plate 25 comes into contact with the next hot plate 26 via veneer P and also raises the hot plate 26, lifting the first arms 30 off of the shoulders 22*b*. If the hydraulic cylinder 59 continues to rise, the hot plates 25 and 26 are elevated along with the respective rollers the endless belts. The hot plates 25 and 26 then come into contact with the lower surface of the next hot plate 27 via the veneer P on the hot plate 26 via the endless belt 54.

Figure 7:
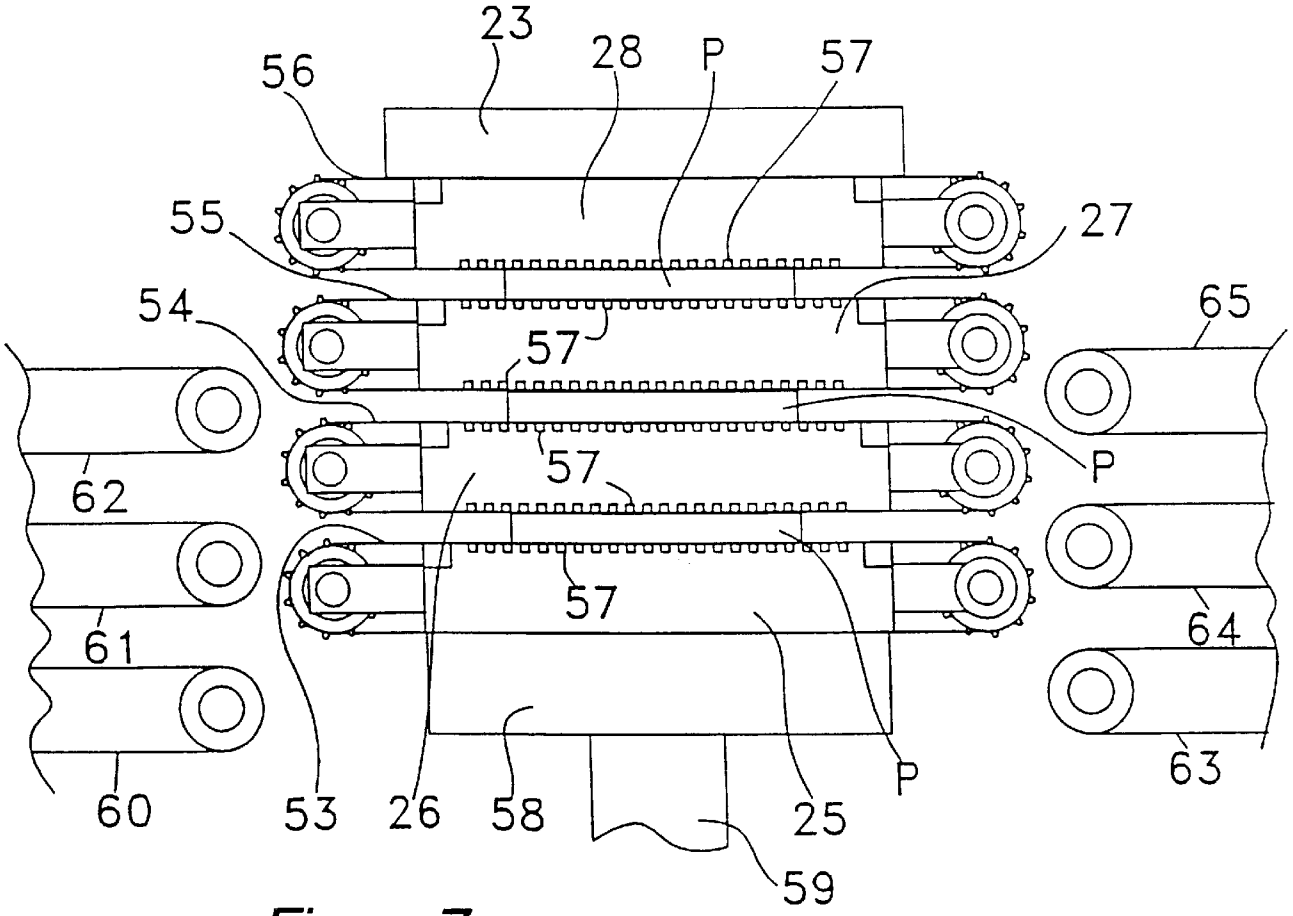
FIG. 7 is another side view of the veneer drying apparatus of FIG. 5 in operation.

As shown in FIG. 7, the hot plates 25–28 eventually abut on the abutment plate 23 while sandwiching veneers P. After the abutment, the pressure of the hydraulic cylinder 59 increases until reaching the aforementioned predetermined value. After that, the pressure is maintained for a predetermined time.

In the mean time, the hot plates 25–28 press and heat both sides of veneers P via the endless belts 53–56, thereby vaporizing moisture inside veneers P. As in the first embodiment, the steam is released into the atmosphere through the numerous small apertures 53*a*–56*a* formed in the endless belts 53–56 and the steam escape grooves 57 formed in the hot plates 25–28, respectively, as explained before.

The time for heating veneers P with the hot plates 25–28 is predetermined according to the initial moisture content, thickness, and desired post-drying moisture content of veneers P. Generally, the post-drying moisture content of about 10% is suitable for bonding veneers with adhesive.

To improve the operation efficiency, the next veneers to be dried should be set on the loading conveyers 60–62 while veneers P are being dried.

Upon expiration of the predetermined drying time, the control unit generates a signal to cause the hydraulic cylinder 59 to lower the support plate 58, the hot plates 25–28, and veneers P interposed between the hot plates. The hot plates 25–28 are eventually returned to their lower positions shown in FIG. 6 in which the first arms 29–32 of the hot plates rest on the shoulders 22*a*–22*d*. As the support plate 58 continues its descent, the limit switch soon detects the support plate reaching the bottom dead point and generates a detection signal. The hydraulic cylinder 59 stops descending in response to this signal.

Then, a restart signal is generated by the control unit to restart the loading and unloading conveyers 59–61 and 63–65, respectively, and the endless belts 53–56 in the direction indicated by the arrows, thereby transferring veneers P from the endless belts 53–56 onto the unloading conveyers 63–65. Meanwhile, the next unheated veneers P are transferred half the length of the endless belt 53–56 and set between the hot plates, starting the same drying procedure again.

The second embodiment provides the following advantages as well as those of the first embodiment:

In the first embodiment, no endless belt is provided around the upper hot plate, so that the upper surface of veneer P abuts directly on the press surface of the upper hot plate, in which the steam escape grooves are formed. This may leave an undesirable groove mark on the upper surface of the veneer P. The drying apparatus of the second embodiment, on the other hand, does not leave any such mark on the surfaces of veneers P because the hot plates abut on the veneer surfaces via the endless belts 53–56. It is of course possible to provide an endless belts around the upper hot plate 3 of the first embodiment or to eliminate the endless belts 56 from the uppermost hot plate 28. If an endless belt is provided around the upper(most) hot plate in either embodiment, the belt, as no veneer is placed thereon, should be rotated in the opposite direction to that of the other belt(s). In this way, this and the immediately lower hot plates travels in the same direction, thereby smoothly transferring the veneer that has been pressed therebetween.

The apparatus of the second embodiment include multiple hot plates with both sides of the hot plates except the lowermost and uppermost plates employed to press and heat veneers. This construction helps improve the heat efficiency of the apparatus.

In the foregoing two embodiments, the surface area of the escape grooves preferably accounts for 15–50%. Likewise, the surface area of the apertures formed in an endless belt preferably accounts for 15–50%.

Figure 8:
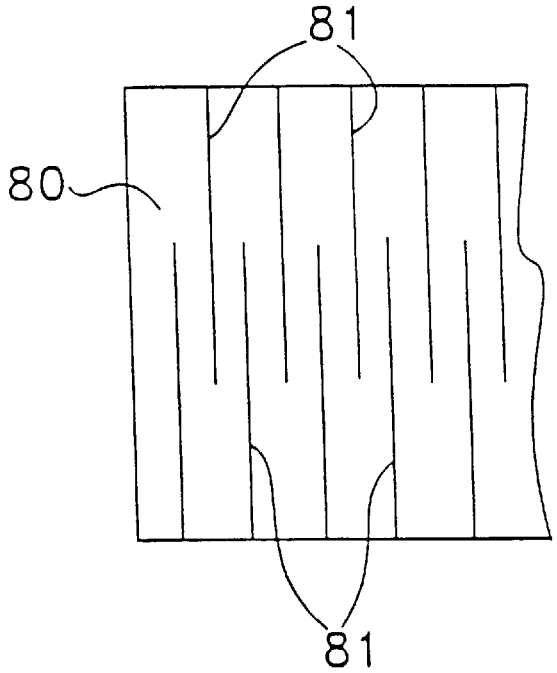
FIG. 8 is a plan view of alternate steam escape grooves formed in hot plates.

The above-explained two embodiments may be modified as follows:

(1) FIG. 8 shows each steam escape grooves 81 which are terminated in the central region of the hot plate 80 and alternately extended to opposite sides of the hot plate whereas in the first and second embodiments, each groove are extended from one side of the hot plate to the other.

In the above embodiments as steam escape grooves are formed in the surface of each hot plate and are not in contact with the endless belts, the surface area of the hot plate from which heat is conducted to veneer P is reduced by the grooves. Accordingly, the hot plate of the embodiments does not have the highest possible heat transfer rate.

Figure 9:
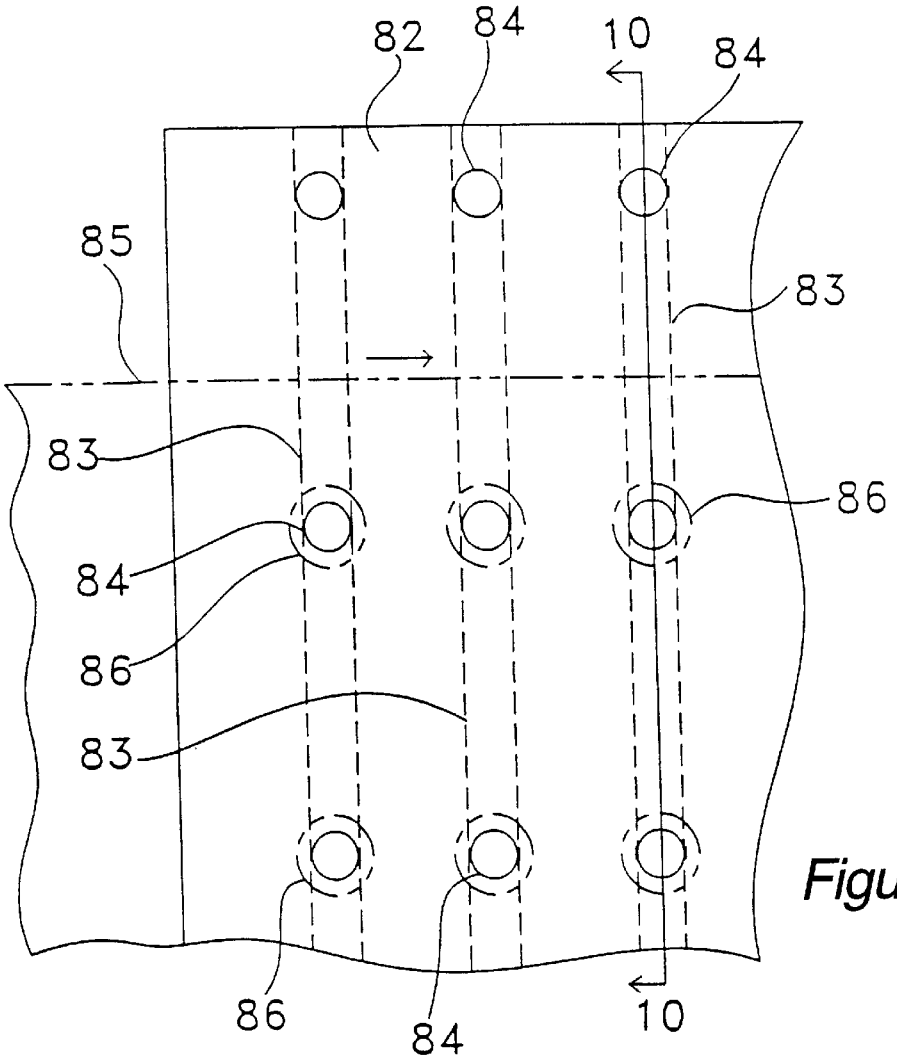
FIG. 9 is a steam escape passage system that can be employed in place of the steam escape grooves of the first and second embodiments.
Figure 10:
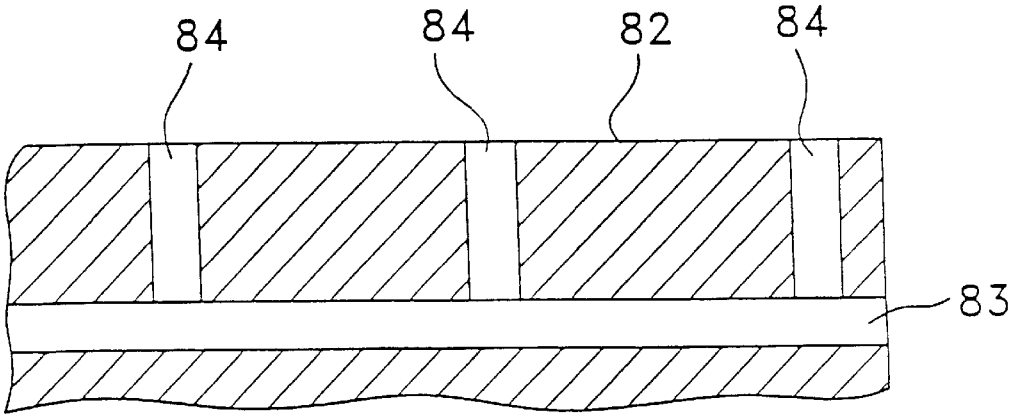
FIG. 10 is a cross sectional view of the steam escape system of FIG. 9 taking along line 10—10.

To enhance the heat transfer rate, steam escape holes may be formed in the hot plate instead of the grooves. Referring to FIGS. 9 and 10, traversal through-holes 83 with an 8 mm-diameter are formed from one side of a hot plate 82 to the other at a 25 mm longitudinal pitch. Also, lateral rows of 8 mm-diameter vertical holes 84 are formed in the press surface of the hot plate 82 so as to be located directly over and connected to the through-holes 83. The vertical holes 84 in the same row are spaced apart from each other at a 50 mm pitch. The rows of vertical holes are not staggered but aligned in the longitudinal direction. The through-holes 83 and the vertical holes 84 constitute a steam escape conduit system. On the other hand, apertures 86 with a 12 mm diameter (shown in broken-line circles in FIG. 9) are formed in endless belts 85 (only one shown). The apertures 86 are arranged so as to be concentrically superimposed on the vertical holes 84 when the endless belts are stopped in the heating and pressing position. That is, the apertures 86 are arranged at a 25 mm pitch in the traveling direction of the endless belts and at a 50 mm pitch in the direction perpendicular to the traveling direction. The endless belts 85 are also controlled with devices, including a proximity switch, as in the first and second embodiments, to superimpose the apertures 86 on the vertical holes 84 when stopped.

With this construction, the entire surface of the hot plate, except where the apertures 84 are located, come into contact with the endless belts to provide a higher heat transfer rate than in the first and the second embodiments. The total area of the apertures 84 is approximately the same as that of the apertures of the two embodiments, so that steam is removed at the same efficiency.

Those skilled in the art will understand that the pitch, number, pattern, and direction of the grooves, the through-holes, and/or the holes can be changed to suit particular applications.

(2) In the first and second embodiments, the longitudinal pitch of the steam escape grooves in the hot plates is the same as that of the apertures in the endless belts, so that the endless belts can be stopped in a position where the apertures are superimposed on or vertically aligned with the grooves. However, if the grooves are formed with a narrower longitudinal pitch, the apertures can be positioned on the grooves wherever the belts are stopped. This eliminates the need for precise position control as performed in the embodiments.

(3) The apertures in the endless belts may be formed in any shape, such as a slot, square, diamond, or hexagonal. Moreover, the apertures may be arranged in different patterns as long as they are formed in regular units each of which corresponds to the length of the outer periphery of the roller and to the arrangement of the protrusions formed on the roller. The number of the apertures in a unit does not have to be the same as that of the protrusions on the roller; there may be more apertures in a unit than the protrusions. In the end, the arrangement, size, and number of the apertures are determined by striking a proper balance between the steam removing efficiency and the belt driving power.

Figure 11:
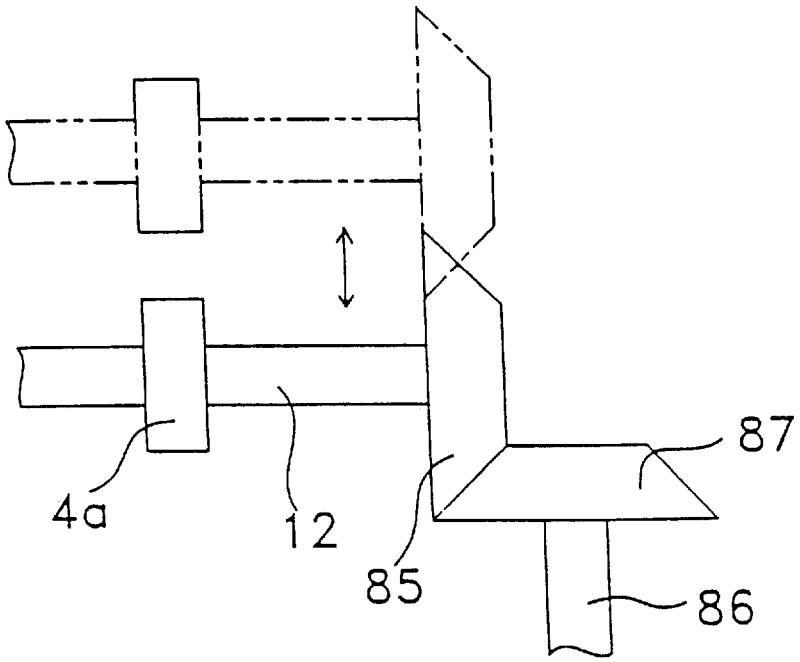
FIG. 11 illustrates the power transmission device that may be employed in the first and second embodiments.

(4) The servo motor(s) for driving the endless belts may be either directly mounted on a side surface of the hot plate(s) or separately installed. In the latter case, a set of bevel gears may be employed to transmit rotation of the servo motor to the driving shaft. As an example, FIG. 11 shows a bevel gear 85 mounted on one end of the driving shaft 12 which engages another bevel gear 87 mounted on one end of the driving shaft 86 of the servo motor (not shown) during normal operation in order to transmit the rotation of the servo motor and to drive the endless belts. When the hot plate is elevated by the support plate, the bevel gears are disengaged from each other. In this way, rotation of the servo motor is not transmitted to the driving shaft even if the motor is erroneously rotating, thereby preventing malfunction of the endless belts while the hot plate is elevated.

(5) In the first and second embodiments, a plurality of endless belts are mounted over driving and driven rollers. Instead, a combined wide belt with the same apertures may be rotated by driving rollers with the same protrusions as in the embodiment.

Figure 12:
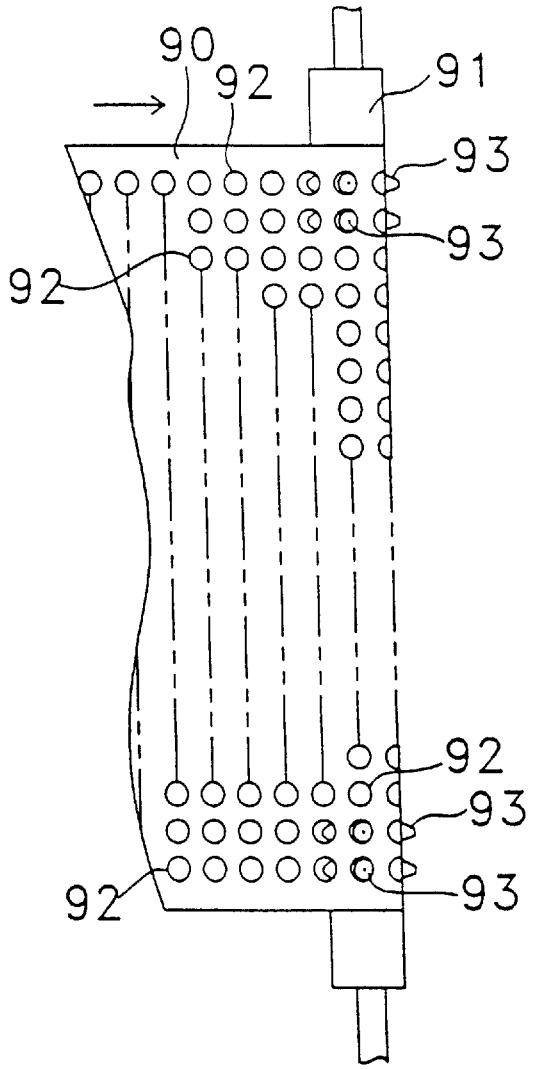
FIG. 12 illustrates an alternate example of the protrusions provided on the driving rollers of the first and second embodiments.

The purpose of providing a plurality of driving rollers at close intervals on a driving shaft is to equalize the load applied to each endless belt. If the endless belt is sufficiently thick and stiff, the belt can be driven by protrusions provided only on the side edges of the driving roller. Referring to FIG. 12, a driving roller 91 has formed on either side thereof two longitudinal rows of protrusions 93 which engage in the corresponding rows of apertures 92 in an endless belt 90. This reduces the cost for manufacturing the roller and also reduces the possibilities of veneers getting caught on protrusions. This arrangement of protrusion can be also applicable to the driven roller.

Moreover, the numbers of driving and driven rollers may be changed to suit various applications.

(6) The loading conveyer 19 may be omitted from the veneer drying apparatus of the first embodiment, so that the operator may manually set veneer P in the apparatus. Likewise, it is also possible to omit the unloading conveyer 20 from the first embodiment, so that veneer P may be manually removed from the apparatus. The present invention can be fully practiced with this modification when applied to the first embodiment although the modification may not be very practical in the second embodiment.

(7) The apparatus of the second embodiment may be modified as shown in FIG. 13 to handle veneer that contains a considerable amount of resin. In the modified apparatus, the steam escape grooves 57 are omitted from the upper surfaces of the hot plates 25–27, so that the upper surfaces of these plates are flat with no grooves. This means that only the lower surfaces of the hot plates 26–28 are provided with the steam escape grooves 57. When veneers P are pressed between the three pairs of opposing hot plates, the resin in veneers P are heated and liquidified while the moisture inside also become vaporized. The liquidified resin, having a greater specific gravity than vapor, does not flow out through the top surfaces of veneers P. Meanwhile, since there are no grooves in the upper surface of the hot plate underneath each veneer P, the entire surface of each veneer P is in contact with the upper surface of that hot plate while being pressed and heated, thereby preventing steam from escaping through the lower surface of veneer P. Consequently, most of the resin remain in veneers P.

In the second embodiment, on the other hand, since each veneer P is pressed by a pair of press surfaces provided with the steam escape grooves 57, most of the contained resin, unable to flows out through the upper surface of veneer P for the above reason, leaks through the lower surface of veneer P. The leaking liquidified resin may adhere to the upper surfaces of the hot plates beneath veneers P and/or find its way between the lower hot plates and their respective endless belts, causing veneers P to be damaged or preventing the belts from running smoothly. In the above-described modified apparatus, however, liquid resin remains inside, thus providing solutions to these problems.

(8) The present invention has been explained as applied to veneer drying apparatuses. However, this invention is also applicable to a so-called "hot-press" apparatus in which adhesive-coated veneers with a high moisture content are laminated by press-heating. To adapt the apparatus shown in FIGS. 5 and 6 for use as a hot-press, for example, the pressure of the hydraulic cylinder is set to approximately 8 kg per square centimeter for effective veneer drying and adhesive curing. As explained above, the endless belts can travel in a stable manner according to the present invention. Moreover, not driven by friction, the endless belts can be relatively thin, so that the entire apparatus can be simplified and made smaller while achieving improved transfer of heat from the belt to veneer P and permitting easy belt replacement.

As there may be many other modifications, alterations, and changes without departing from the scope or spirit of the essential characteristics of the present invention, it is to be understood that the above embodiment is only an illustration and not restrictive in any sense. The scope or spirit of the present invention is limited only by the terms of the appended claims.

What is claimed is:

1. A veneer drying apparatus, comprising:

a pair of upper and lower hot plates adapted to be heated by heating means, each of the hot plates having upper and lower surfaces, wherein the upper surface of said lower hot plate and the lower surface of said upper hot plate constitute a pair of opposing upper and lower heating surfaces for heating a veneer therebetween;

rollers provided on loading and unloading sides of said lower hot plate;

an intermittently drivable endless belt mounted over said rollers and adapted to travel over said upper surface of said lower hot plate from said loading side to said unloading side of said lower hot plate, for transferring a veneer to a position between said pair of upper and lower hot plates and carrying off said veneer from said position;

pressure means provided under and over said upper and lower hot plates for pressing and heating said veneer positioned between said upper and lower hot plates before said veneer is automatically carried off by said endless belt;

steam escape means formed at least in the lower one of said two opposing heating surfaces of said upper and lower hot plates, said steam escape means being in communication with the outside thereof;

numerous apertures formed in the entire surface of said endless belt, said apertures being arranged in a regular pattern in the traveling direction of said endless belt; and numerous protrusions provided on the periphery of each of said rollers for engaging in at least part of said numerous apertures of said endless belt, wherein said regular pattern of said apertures is composed of units each of which corresponds to the length of said periphery of each of said rollers.

2. The veneer drying apparatus in accordance with claim 1 wherein said protrusions are provided on the entire periphery of said rollers.

3. The veneer drying apparatus in accordance with claim 1 wherein said protrusions are provided only on side edges of the periphery of said rollers.

4. The veneer drying apparatus in accordance with claim 1 wherein said endless belt is sectioned in the direction perpendicular to said traveling direction thereof.

5. The veneer drying apparatus in accordance with claim 1 wherein said regular pattern of apertures is composed of staggered rows of apertures extending perpendicular to said traveling direction in each of which row the apertures are located at a regular pitch, with the distance between any adjacent rows corresponding to half the distance of said regular pitch.

6. The veneer drying apparatus in accordance with claim 1 wherein each of the hot plates in which said steam escape means is formed has a plurality of openings on side surfaces thereof, said side surfaces extending in parallel to said traveling direction of said endless belt and said openings being in communication with said steam escape means.

7. The veneer drying apparatus in accordance with claim 6 wherein said steam escape means comprises a plurality of steam escape grooves in communication with the outside of the hot plate.

8. The veneer drying apparatus in accordance with claim 6 wherein said steam escape means comprises a plurality of steam escape holes in communication with the outside of the hot plate.

9. A multiple-tiered veneer drying apparatus, comprising:

a plurality of vertically disposed hot plates capable of being stacked on top of each other, each hot plate being adapted to be heated by heating means, wherein each of the hot plates except the uppermost and lowermost hot plates has upper and lower heating surfaces, said uppermost hot plate having a lower heating surface only and the lowermost hot plate having an upper heating surface only;

transfer means provided for each hot plate, said transport means including rollers provided on loading and unloading sides of each hot plate and an intermittently drivable endless belt mounted over said rollers, for traveling over said upper surface of the hot plate from said loading side to said unloading side of the hot plate so as to transfer a veneer to a position between the hot plate and the hot plate disposed immediately above thereof and to carry off said veneer from said position;

pressure means provided under the lowermost hot plate and over the uppermost hot plate for pressing and heating said veneers positioned between said hot plates before said veneers are automatically carried off by said endless belts;

steam escape means formed in at least one of the two opposing heating surfaces of each pair of opposing hot plates, said steam escape means being in communication with the outside thereof;

numerous apertures formed in the entire surface of each endless belt, said apertures being arranged in a regular pattern in the traveling direction of the endless belt; and numerous protrusions provided on the periphery of each of said rollers for engaging in at least part of said numerous apertures of the corresponding endless belt, wherein said regular pattern of said apertures is composed of units each of which corresponds to the length of said periphery of each of said rollers.

10. The veneer drying apparatus in accordance with claim 9 wherein said steam escape means is formed only in the upper one of the two opposing heating surfaces of each pair of opposing hot plates.

11. The veneer drying apparatus in accordance with claim 9 further comprising a hot plate not provided with transfer means, said hot plate being disposed over said uppermost hot plate provided with transfer means so as to make a pair for performing heating and pressing.

12. The veneer drying apparatus in accordance with claim 9 wherein said protrusions are provided on the entire periphery of said rollers.

13. The veneer drying apparatus in accordance with claim 9 wherein said protrusions are provided only on side edges of the periphery of said rollers.

14. The veneer drying apparatus in accordance with claim 9 wherein said endless belts are sectioned in the direction perpendicular to said traveling direction thereof.

15. The veneer drying apparatus in accordance with claim 9 wherein said regular pattern of apertures is composed of staggered rows of apertures extending perpendicular to said traveling direction in each of which row the apertures are located at a regular pitch, with the distance between any adjacent rows corresponding to half the distance of said regular pitch.

16. The veneer drying apparatus in accordance with claim 9 wherein each of the hot plates in which said steam escape means is formed has a plurality of openings on side surfaces thereof, said side surfaces extending in parallel to said traveling direction of said endless belt and said openings being in communication with said steam escape means.

17. The veneer drying apparatus in accordance with claim 16 wherein said steam escape means comprises a plurality of steam escape grooves in communication with the outside of the hot plate.

18. The veneer drying apparatus in accordance with claim 16 wherein said steam escape means comprises a plurality of steam escape holes in communication with the outside of the hot plate.

19. The veneer drying apparatus in accordance with claim 2 wherein each of the hot plates in which said steam escape means is formed has a plurality of openings on side surfaces thereof, said side surfaces extending in parallel to said traveling direction of said endless belt and said openings being in communication with said steam escape means.

20. The veneer drying apparatus in accordance with claim 3 wherein each of the hot plates in which said steam escape means is formed has a plurality of openings on side surfaces thereof, said side surfaces extend in parallel to said traveling direction of said endless belt and said openings being in communication with said steam escape means.

21. The veneer drying apparatus in accordance with claim 4 wherein each of the hot plates in which said steam escape means is formed has a plurality of openings on side surfaces thereof, said side surfaces extending in parallel to said traveling direction of said endless belt and said openings being in communication with said steam escape means.

22. The veneer drying apparatus in accordance with claim 5 wherein each of the hot plates in which said steam escape means is formed has a plurality of openings on side surfaces thereof, said side surfaces extending in parallel to said traveling direction of said endless belt and said openings being in communication with said steam escape means.

23. The veneer drying apparatus in accordance with claim 10 wherein each of the hot plates in which said steam escape means is formed has a plurality of openings on side surfaces thereof, said side surfaces extending in parallel to said traveling direction of said endless belt and said openings being in communication with said steam escape means.

24. The veneer drying apparatus in accordance with claim 11 wherein each of the hot plates in which said steam escape means is formed has a plurality of openings on side surfaces thereof, said side surfaces extending in parallel to said traveling direction of said endless belt and said openings being in communication with said steam escape means.

25. The veneer drying apparatus in accordance with claim 12 wherein each of the hot plates in which said steam escape means is formed has a plurality of openings on side surfaces thereof, said side surfaces extending in parallel to said traveling direction of said endless belt and said openings being in communication with said steam escape means.

26. The veneer drying apparatus in accordance with claim 13 wherein each of the hot plates in which said steam escape means is formed has a plurality of openings on side surfaces thereof, said side surfaces extending in parallel to said traveling direction of said endless belt and said openings being in communication with said steam escape means.

27. The veneer drying apparatus in accordance with claim 14 wherein each of the hot plates in which said steam escape means is formed has a plurality of openings on side surfaces thereof, said side surfaces extend in parallel to said traveling direction of said endless belt and said openings being in communication with said steam escape means.

28. The veneer drying apparatus in accordance with claim 15 wherein each of the hot plates in which said steam escape means is formed has a plurality of openings on side surfaces thereof, said side surfaces extending in parallel to said traveling direction of said endless belt and said openings being in communication with said steam escape means.

29. The veneer drying apparatus in accordance with claim 23 wherein said steam escape means comprises a plurality of steam escape grooves in communication with the outside of the hot plate.

30. The veneer drying apparatus in accordance with claim 24 wherein said steam escape means comprises a plurality of steam escape grooves in communication with the outside of the hot plate.

31. The veneer drying apparatus in accordance with claim 25 wherein said steam escape means comprises a plurality of steam escape grooves in communication with the outside of the hot plate.

32. The veneer drying apparatus in accordance with claim 26 wherein said steam escape means comprises a plurality of steam escape grooves in communication with the outside of the hot plate.

33. The veneer drying apparatus in accordance with claim 27 wherein said steam escape means comprises a plurality of steam escape grooves in communication with the outside of the hot plate.

34. The veneer drying apparatus in accordance with claim 28 wherein said steam escape means comprises a plurality of steam escape grooves in communication with the outside of the hot plate.

35. The veneer drying apparatus in accordance with claim 23 wherein said steam escape means comprises a plurality of steam escape holes in communication with the outside of the hot plate.

36. The veneer drying apparatus in accordance with claim 24 wherein said steam escape means comprises a plurality of steam escape holes in communication with the outside of the hot plate.

37. The veneer drying apparatus in accordance with claim 25 wherein said steam escape means comprises a plurality of steam escape holes in communication with the outside of the hot plate.

38. The veneer drying apparatus in accordance with claim 26 wherein said steam escape means comprises a plurality of steam escape holes in communication with the outside of the hot plate.

39. The veneer drying apparatus in accordance with claim 27 wherein said steam escape means comprises a plurality of steam escape holes in communication with the outside of the hot plate.

40. The veneer drying apparatus in accordance with claim 28 wherein said steam escape means comprises a plurality of steam escape holes in communication with the outside of the hot plate.

* * * * *